US005968841A

United States Patent [19]

Landers et al.

[11] Patent Number: 5,968,841

[45] Date of Patent: Oct. 19, 1999

[54] DEVICE AND METHOD FOR PREVENTING SETTLEMENT OF PARTICLES ON A CHEMICAL-MECHANICAL POLISHING PAD

[75] Inventors: William Francis Landers, Wappingers Falls; Michael Francis Lofaro, Milton; Adam Dan Ticknor, Wappingers Falls, all of N.Y.

[73] Assignee: International Business Machines Corporation, Armonk, N.Y.

[21] Appl. No.: 08/851,920

[22] Filed: May 6, 1997

[51] Int. Cl.[6] ..... H01L 21/00

[52] U.S. Cl. ..... 438/692; 156/345; 216/89; 438/693

[58] Field of Search ..... 438/691, 692, 438/693, 747; 156/345 LP; 216/38, 88, 89, 90; 451/910

[56] References Cited

U.S. PATENT DOCUMENTS 3,093,937 6/1963 Balamuth et al. .
4,004,375 1/1977 Wieck .
5,245,790 9/1993 Jerbic .
5,245,796 9/1993 Miller et al. .
5,399,234 3/1995 Yu et al. .
5,522,965 6/1996 Chisholm et al. .
5,531,861 7/1996 Yu et al. .
5,688,364 11/1997 Sato ..... 438/693

OTHER PUBLICATIONS

*Mechanical Engineering*, "Designing Intelligent Machines", vol. 177, No. 11 (1995) pp. 77–81.

Brochure on Vibration Reduction by Active Control eXperts, Inc., 1994.

Brochure on PZT QuickPack by Active Control eXperts, Inc., 1995.

*Primary Examiner*—William Powell
*Attorney, Agent, or Firm*—Scully, Scott, Murphy & Presser; Ira D. Blecker

[57] ABSTRACT

A device and method for preventing settlement of particles on a chemical-mechanical polishing pad is provided. Specifically, a device capable of preventing settlement of particles on the pad is located between the polishing pad and a platen of a chemical-mechanical polishing apparatus.

52 Claims, 2 Drawing Sheets

DEVICE AND METHOD FOR PREVENTING SETTLEMENT OF PARTICLES ON A CHEMICAL-MECHANICAL POLISHING PAD

BACKGROUND OF THE INVENTION

1. Field of the Invention

The present invention is directed to a device and method for preventing settlement of particles on a chemical-mechanical polishing pad, and more particularly, to a device placed between the polishing pad and a platen of a chemical-mechanical polishing apparatus used during the fabrication of semiconductor devices.

2. Discussion of the Prior Art

During fabrication of semiconductor devices, irregular top surfaces result due to many manufacturing processes, such as forming conductive lines and single or multiple layers. During various stages of semiconductor wafer production, irregular top surfaces of the wafers are planarized or flattened to provide smooth surfaces. Planarized surfaces improve performance and yield of integrated circuits formed on the wafer.

Chemical-mechanical polishing (CMP) is one method to planarized wafer surfaces. In the CMP process, the wafer is rubbed with a polishing pad. The rubbing is accomplished by pressing the wafer or polishing pad toward each other, and rotating one or both of them relative to each other. A slurry is used to chemically/mechanically attack the wafer surface and facilitate removal thereof by the mechanical abrasion provided by the rotating polishing pad.

Particles are generated from wafer abrasion (i.e., the mechanical abrasion of the wafer surface being polished), from slurry agglomeration (i.e., slurry particles that coalesce, which slurry particles are approximately 0.05 microns in size), and from pad debris resulting from polishing pad disintegration. These particles embed or settle within the polishing pad fabric, and protrude during the polish process causing wafer scratching, defects and improper planarazation.

Furthermore, the embedded particles change the surface structure of the polishing pad, resulting in process instability, and reduced repeatability and polish or removal rate. In extreme cases, the decline in the polish or removal rate results in an incomplete removal of material, leading to degradation in polishing uniformity. Polishing uniformity is further degraded due to particles being embedded on the pad in a non-uniform fashion. For example, a particular area of the pad may have more particles embedded therein than other areas. This non-uniformity is further accentuated when the wafer surface contains areas of different material, that are removed or polished at different rates.

The embedded particles also reduce the pad useful life, thus requiring frequent changing of the polishing pads. In addition to the cost of the pads, replacing the pads interrupts the wafer manufacturing process and reduces efficiency and yield. Moreover, this necessitates conditioning the pads prior to use, e.g., by planarizing the pads prior to use.

To prevent particles from being embedded in the polishing pad, an ultrasonic transducer has been placed in the slurry to vibrate or agitate the slurry. The ultrasonic transducer is either suspended in the slurry, or rests on the polishing pad. Alternatively, the ultrasonic transducer has been placed in contact with the wafer being polished, or placed under a platen disk onto which the polishing pad is attached, on a side of the platen that is opposite the pad polishing side. However, conventional devices using an ultrasonic transducer do not provide flexibility in providing directed vibration to specifically desired regions of the pad. This causes regional defects on the polished wafer surface and requires frequent changing of the polishing pad.

In addition to the slurry vibration, a large portion of the CMP device is also vibrated, causing undue wear and noise that degrade performance of the CMP device. This results in slow polishing rates and defective wafer polishing. Accordingly, there is a need for a versatile CMP device that variably controls prevention of particles from being embedding in the polishing pad at specific desired locations, and reduces vibration of portions of the CMP device that are adversely affected by undesired vibration.

SUMMARY OF THE INVENTION

The object of the present invention is to provide a device and method for preventing settlement of particles on a chemical-mechanical polishing pad used in chemical-mechanical polishing (CMP) that eliminate the problems of conventional CMP devices and methods.

Another object of the present invention is to lengthen the useful life of a polishing pad used in CMP devices.

Yet another object of the present invention is to reduce defects in the polished surface of the wafer.

A further object of the present invention is to maintain a fast and uniform polish rate of wafer surfaces.

A still further object of the present invention is to direct controlled vibration at desired locations of the polishing pad, while reducing vibration at other portions of the CMP device.

These and other objects of the present invention are achieved by a device, located between a polishing pad and a platen of a chemical-mechanical polishing apparatus, for preventing settlement of particles on the polishing pad, comprising a first layer formed on the platen for interfacing therewith, also referred to as a platen interface layer; a second layer formed on the first layer having at least one vibration module embedded therein, also referred to as an active layer; and a third layer formed on the second layer facing the pad and having an energy transport medium, also referred to as an energy transport layer.

The active layer selectively vibrates regions of the energy transport layer, and the energy transport layer selectively transfers the vibration to the pad located over the energy transport layer.

The vibration module provides accentuated vibration to a side facing the energy transport layer, and attenuated vibration to remaining sides thereof. This is achieved, for example, by surrounding the vibration module by a damping material on all sides except a side contacting the energy transport layer. Illustratively, the vibration module is a piezoelectric or a mechanical actuator. Alternatively, the vibration module is a megasonic or an ultrasonic transducer. Power and signal lines are embedded in the platen interface layer and are connected to the vibration module.

The energy transport medium is configured to provide selective energy transfer from the active layer to the polishing pad. To provide a selective energy transfer, the energy transfer characteristic of the energy transport medium varies over different regions thereof. For example, the density or thickness of the energy transport medium varies over different regions thereof. Illustratively, the energy transport medium is a mesh, such as a metal wire mesh, which may be embedded in bulk material.

The energy transfer characteristic of the energy transport medium may also be selectively varied over different regions thereof by varying the weave of the embedded mesh, and the thickness or density of the wire.

In one embodiment, the three layers are removably formed over each other. In another embodiment, the platen interface layer is affixed to the platen, for example, by an adhesive. The three layers are formed of the same bulk material, which may be a polymer, for example. The bulk material may be the same as that of the polishing pad. The bulk material of the active layer has a hole formed therein for receiving the vibration module.

Another embodiment includes a method for preventing settlement of particles on a polishing pad of a chemical-mechanical polishing apparatus comprising the steps: of selectively vibrating at least one vibration module embedded in an active layer; and selectively transferring the vibration through an energy transport layer formed on the active layer to the polishing pad located over the energy transport layer.

A further embodiment is a method for forming a device for preventing settlement of particles on a polishing pad of a chemical-mechanical polishing apparatus comprising the steps of: forming a platen interface layer for interfacing with a platen of the chemical-mechanical polishing apparatus; forming an active layer on the platen interface layer; and forming an energy transport layer on the active layer facing the pad. The active layer forming step forms the active layer to selectively vibrate regions of the energy transport layer, and the energy transport layer forming step forms the energy transport layer to selectively transfer the vibration to the polishing pad located over the energy transport layer.

For example, the energy transport layer forming step forms the energy transport layer with an energy transfer characteristic that varies over different regions of the energy transport layer. The active layer forming step includes the steps of forming a bulk material; forming a hole in the bulk material; forming a vibration damping material in the hole; and placing a vibration module in the vibration damping material so that a top surface of the vibration module directs vibration energy to the energy transport layer, and sides and bottom of the vibration module direct vibration energy to the vibration damping material.

The inventive device and method, where selected regions of the polishing pad are vibrated by a individually controlled vibration modules, prevent settlement of particle on the polishing pad, lengthen the useful life thereof, and reduce the need and frequency to condition the polishing pad, e.g., prior to use. Furthermore, the inventive device and method reduce defects in the polished surface of the wafer. In addition, the inventive device and method allow uniform polishing of the wafer at a high rate, thus improving yield.

Moreover, the inventive device and method reduce CMP device wear by reducing undesired vibration of portions thereof, while directing controlled and selective vibration to the polishing pad and slurry.

BRIEF DESCRIPTION OF THE DRAWINGS

Further features and advantages of the invention will become more readily apparent from a consideration of the following detailed description set forth with reference to the accompanying drawings, which specify and show preferred embodiments of the invention, wherein like elements are designated by identical references throughout the drawings; and in which.

DETAILED DESCRIPTION OF THE INVENTION

Figure 1:
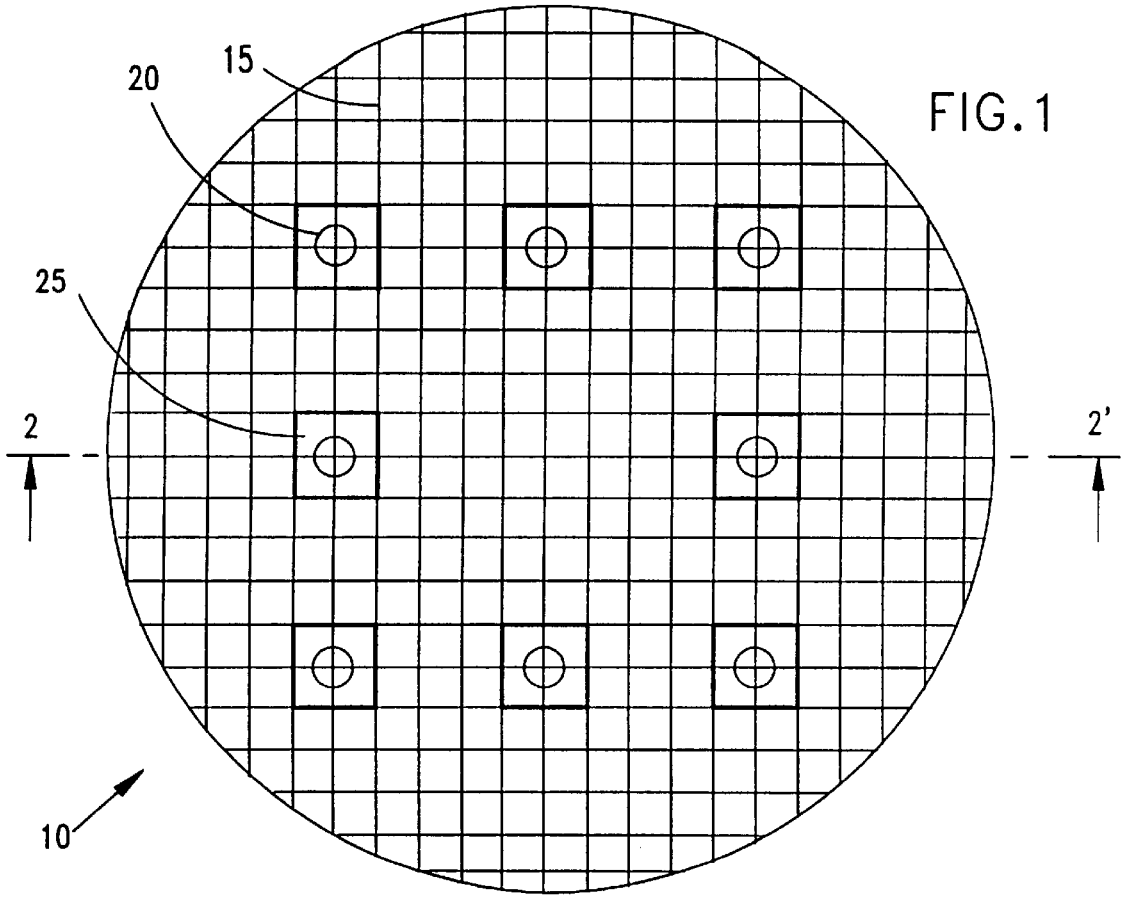
FIG. 1 shows a top view of a device according to the present invention.

FIG. 1 shows a top view of a device 10 according to the present invention, where bulk material that contains the various elements of the device 10 is omitted. FIG. 1 shows a mesh 15, such as a wire frame mesh, formed over vibration modules 20. Illustratively, the wire mesh 15 and vibration modules 20 are embedded in bulk material 155, 160, respectively, shown in FIG. 3. Eight vibration modules 20 are shown in FIG. 1. However, any number of modules 20 including only one module may be used, depending on the amount and location of the desired vibration to be delivered to a polishing pad 70 (FIG. 2) placed over the device 10. In addition, each vibration module 20 may be controlled separately to selectively provide a desired level of vibration, or no vibration, to particle regions of the device 10.

Figure 2:
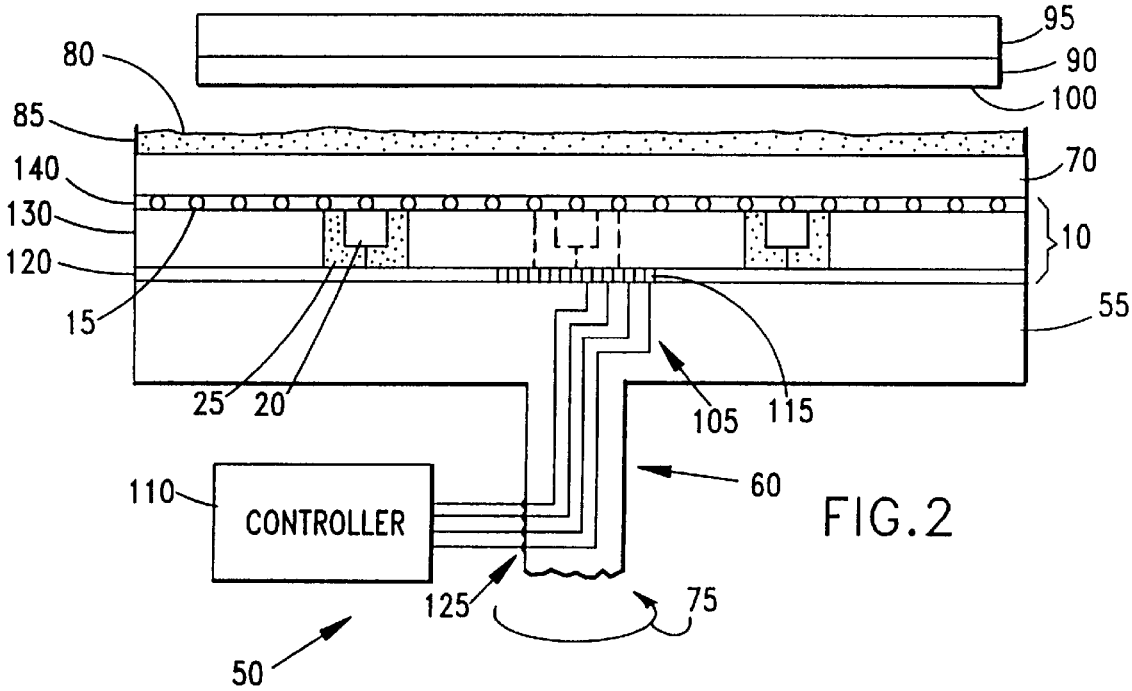
FIG. 2 shows a cross section of the device of FIG. 1 along the line 2-2' according to the present invention.
Figure 3:
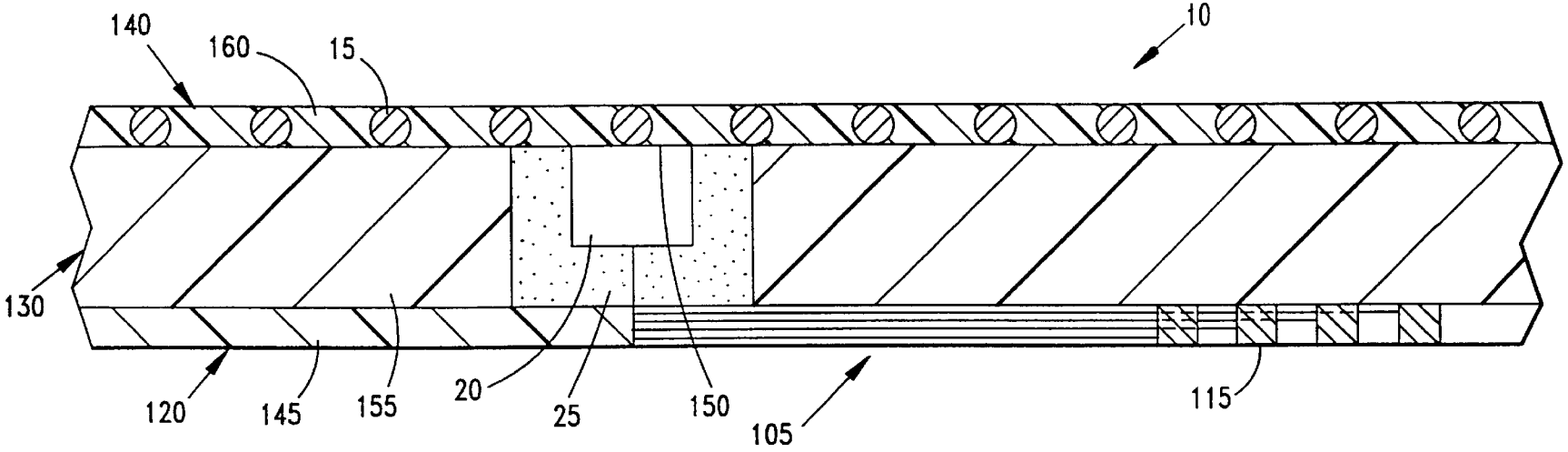
FIG. 3 shows an enlarged portion of the cross section of the device of FIG. 1 according to the present invention.

Each vibration modules 20 is surrounded by a vibration damping material 25 on all sides except a top side facing the wire mesh 15, as is more clearly shown in FIGS. 2 and 3. This accentuates and directs vibration toward the wire mesh 15, and dampens vibration coming from the side and bottom portions of each vibration modules 20.

FIG. 2 shows a cross section of the device 10 along the line 2-2' of FIG. 1, where the device 10 is mounted on a chemical-mechanical polishing (CMP) apparatus 50, between a platen 55 and a polishing pad 70 of the CMP apparatus 50. The device 10 is mounted on the platen 55, which is rotatable and has a shaft 60 that is connected to a motor (not shown). The polishing pad 70 is mounted on the device 10. As the shaft 60 is rotated, as indicated by arrow 75, the platen 55, device 10 and pad 70 also rotate. A slurry 80 is introduced over the pad 70. The slurry 80 is contained within a raised rim 85 of the platen 55, for example. A wafer 90, attached to a carrier 95, is pressed against the rotating polishing pad 70 for planarizing a wafer surface 100 facing the pad 70. The wafer 90 may also be rotated by a motor (not shown) connected to the carrier 95.

Power and signal lines 105 connect the vibration modules 20 to a controller 110 for individually, collectively or selectively controlling and vibrating the vibration modules 20. Illustratively, the lines 105 have contact leads 115 embedded in an interface layer 120 of the device 10 for interfacing with the vibration modules 20. In addition, the lines 105 also have shaft contact leads 125, that are located on the shaft 60, for interfacing with the controller 110.

In operation, the device 10 is attached to the platen 55 and is rotated by rotating the shaft 60 of the platen 55 with a motor (not shown). The controller 110 sends appropriate signals to the vibration modules 20 to selectively vibrate individual modules at desired frequencies and intensities. The frequency and/or intensity of each module 20 may be controlled collectively or individually. In the case where each module 20 is individually controlled, different amount of vibration is provided over different regions. For example, one or many modules 20 may be vibrated at a different intensities or frequencies than other modules.

Depending on the energy transfer characteristics of the wire mesh, which may also be varied over different regions of the device 10, a desired vibration is transferred to particular regions of the polishing pad 70. The vibrating pad 70 also vibrates the slurry 80, keeps particles suspended in the slurry, and prevents settlement thereof on the pad 70, or within pores of the pad 70. This results in fast and proper polishing of the wafer surface 100 which is pressed against the polishing pad 70.

FIG. 3 shows a portion of the cross section of the device 10 in greater detail. In addition to the first layer 120, the device 10 also comprises second and third layers 130, 140. The first layer 120, also referred to as a platen interface layer, interfaces with the platen 55 (FIG. 2), and is formed of a bulk material 145, such as a polymer or other suitable casting material. The power and signal lines 105 are embedded in the polymer of the interface layer 120 and electrically connect the vibration modules 20 to the contact leads 115 that are also embedded in the interface layer 120. The contact leads 115 interface with the lines in the platen 55.

The second layer 130, also referred to as an active layer, is formed on the interface layer 120 and contains embedded therein at least one vibration module 20. Illustratively, the vibration modules 20 are piezoelectric or mechanical actuators, such as those that are commercially available from Active Control eXperts, Inc., (ACX) of Cambridge, Mass. Alternatively the vibration modules 20 are conventional megasonic, ultrasonic or other suitable frequency transducers, such as those that are commonly used in the semiconductor industry for wafer cleaning devices. Different frequencies are used depending on process conditions.

As previously described in connection with FIG. 1, each vibration module 20 is enveloped within a cell having the vibration damping material 25 that surround the vibration module 20 on all sides except the top side 150 that faces the third layer 140. This top side 150 of the vibration module 20 may contact the wire mesh 15 embedded in the third layer 140.

The vibration damping material 25 ensures that no vibrations are transmitted to the platen 55 (FIG. 2), and thereby, to the physical components of the tooling or the CMP apparatus 50 (FIG. 2). Without the vibration damping material 25, undue vibration of the tooling causes accelerated wear and run-out of the tooling component operating specification. Furthermore, the undue vibration causes additional and unacceptable noise levels.

Each vibration module 20 is embedded in a bulk material 155, which may be the same bulk material 160 that contains the wire mesh 15. Illustratively, all three bulk materials 145, 155, 160 of the first to third layers 120, 130, 140, are of the same type, which may be the same type as the bulk material of the polishing pad 70 (FIG. 2).

The third layer 140, also referred to as an energy transport layer, is formed on the active layer 130 and has an energy transport medium embedded therein. Illustratively, the energy transport medium is the wire mesh 15. The wire mesh 15 may be made from a wide variety of material that transfer or conduct vibration energy. A high density metal is preferable for its high workability and durability.

The physical attributes of the wire mesh 15, such as wire thickness, density and the weave of the wire mesh, may be tailored to provide various effects as desired, depending on polishing pad type and thickness, for example. Illustratively, a thicker wire having a greater cross sectional area may be used for hard polishing pads than wire used for soft polishing pads. In addition, the density of the wire material affects the rate at which the vibration energy is distributed throughout the wire and transferred to the polishing pad 70 (FIG. 2). These and other physical attributes of the wire mesh are tailored for optimum performance to individual circumstances.

One or more of the physical attributes or characteristics of the wire mesh 15 or the energy transport layer 140 may be varied over different regions thereof, to provide selective energy transfer from the active layer 130 of the device 10 to the polishing pad 70 (FIG. 2). For example, if buildup of slurry particles, agglomerates or residuals is found to be greatest at the perimeter of the polishing pad 70, then the weave of the wire mesh 15 at regions near the periphery of device 10 is tighter than the weave at regions of the mesh that are away from the device periphery. Alternatively, or in addition to, the density or thickness of the wire near the device periphery is made different from the wire density/thickness located away from the device periphery to produce a correspondingly greater amount of vibration near the device periphery.

The three layers 120, 130, 140 may be an integral unit. Alternatively, each of the three layers 120, 130, 140 are separate components that are placed over each other. This is desirable as it allows flexibility in exchanging the layers, in particular, exchanging the active and energy transport layers 130, 140, with similar layers having different desired characteristics. For example, different active layers 130 may be used in different condition, where the particular active layer 130 used has a desired number of vibration modules at desired locations. Similarly, the energy transport layer 140 may be exchanged with another energy transport layer having a desired thickness, density and weave of the wire mesh 15.

Illustratively, the interface layer 120 is affixed to the platen 55 on a semi-permanent basis, e.g., with an adhesive. This prevents the interface layer 120 from slipping or moving during polishing, when the platen 55 is rotated. The top two layers, i.e., the active and energy transport layers 130, 140 are removably affixed to each other, and the active layer 130 is removably affixed to the interface layer. This allows replacing thereof with other active and energy transport layers having desired characteristics, as described. In addition, the active layer 130 is removed for servicing or replacing the actuators or transducers of the vibration modules 20.

The energy interface layer 140 may be formed by placing the wire mesh 15 in a mold or form, and the polymer poured to fill the form. The active layer 130 is also formed in a similar fashion. Alternatively, the active layer 130 is formed by first pouring the polymer in a form. After the poured polymer has cured, one or as many holes as desired are cut out, e.g., drilled, at desired locations. Next, the damping material 25, the vibration modules 20 and necessary wiring are placed in the holes. The size of the holes may be varied depending on the size of the damping material 25 and the vibration modules 20.

Referring to FIGS. 2 and 3, another embodiment includes a method for preventing settlement of particles on the polishing pad 70 of the chemical-mechanical polishing apparatus 50. This method comprises the steps of selectively vibrating at least one vibration module embedded in the active layer 130; and selectively transferring the vibration, through the energy transport layer 140 formed on the active layer 130, to the polishing pad 70 located over the energy transport layer 140.

A further embodiment is a method for forming the device 10 that prevents settlement of particles on the polishing pad 70. This method comprises the steps of forming a platen interface layer 120 for interfacing with the platen 55 of the chemical-mechanical polishing apparatus 50; forming the active layer 130 on the platen interface layer 120; and forming the energy transport layer 140 on the active layer facing the pad 70. The active layer forming step forms the active layer 130 to selectively vibrate regions of the energy transport layer 130, and the energy transport layer forming step forms the energy transport layer 140 to selectively transfer the vibration to the polishing pad 70 located over the energy transport layer 130.

For example, the energy transport layer forming step forms the energy transport layer 140 with an energy transfer characteristic that varies over different regions thereof. The active layer forming step includes the steps of forming a bulk material; forming a hole in the bulk material; forming a vibration damping material 25 in the hole; and placing a vibration module 20 in the vibration damping material 25 so that a top surface 150 of the vibration module 20 directs vibration energy to the energy transport layer 140, and sides and bottom of the vibration module 20 direct vibration energy to the vibration damping material 25.

While the invention has been particularly shown and described with respect to illustrative and preformed embodiments thereof, it will be understood by those skilled in the art that the foregoing and other changes in form and details may be made therein without departing from the spirit and scope of the invention which should be linked only by the scope of the appended claims.

Having thus described our invention, what we claim as new, and desire to secure by Letters Patent is:

1. A device located between a polishing pad and a platen of a chemical-mechanical polishing apparatus for preventing settlement of particles on the polishing pad comprising:

a first layer for interfacing with the platen;

a second layer formed on said first layer having at least one vibration module embedded therein; and a third layer formed on said second layer facing the pad and having an energy transport medium.

2. The device of claim 1, wherein said at least one vibration module is surrounded by a damping material on all sides except a side contacting said third layer.

3. The device of claim 2, wherein a top surface of said at least one vibration module directs vibration energy to said energy transport medium, and sides and bottom of said at least one vibration module direct vibration energy to said damping material.

4. The device of claim 1, wherein said at least one vibration module provides accentuated vibration to a side facing said third layer and attenuated vibration to remaining sides thereof.

5. The device of claim 1, wherein said at least one vibration module is one of a piezoelectric and a mechanical actuator.

6. The device of claim 1, wherein said at least one vibration module is one of a megasonic and an ultrasonic transducer.

7. The device of claim 1 further comprising power and signal lines embedded in said first layer and connected to said at least one vibration module.

8. The device of claim 1, wherein said energy transport medium is configured to provide selective energy transfer from said second layer to said polishing pad.

9. The device of claim 1, wherein an energy transfer characteristic of said energy transport medium varies over different regions thereof.

10. The device of claim 1, wherein a density of the energy transport medium varies over different regions thereof.

11. The device of claim 1, wherein a thickness of the energy transport medium varies over different regions thereof.

12. The device of claim 1, wherein the energy transport medium is a mesh embedded in bulk material.

13. The device of claim 12, wherein a weave of the embedded mesh varies over different regions thereof.

14. The device of claim 1, wherein the energy transport medium is a wire mesh.

15. The device of claim 14, wherein the wire is metal.

16. The device of claim 1, wherein said first, second and third layers are formed of a same bulk material.

17. The device of claim 16, wherein said bulk material is a polymer.

18. The device of claim 1, wherein said first, second and third layers are formed from a bulk material of the pad.

19. The device of claim 1, wherein said first, second and third layers are removably formed over each other.

20. The device of claim 1, wherein said first layer is affixed to the platen.

21. The device of claim 1, wherein said first layer is affixed to the platen by an adhesive.

22. The device of claim 1, wherein said second layer has at least one hole for receiving said at least one vibration module.

23. A device located between a pad and a platen of a chemical-mechanical polishing apparatus comprising:

a platen interface layer formed on the platen;

an active layer formed on said interface layer; and an energy transport layer formed on said active layer facing the pad, said active layer selectively vibrating regions of said energy transport layer, and said energy transport layer selectively transferring the vibration to the pad located over said energy transport layer.

24. A method for preventing settlement of particles on a polishing pad of a chemical-mechanical polishing apparatus comprising the steps of:

selectively vibrating at least one vibration module embedded in an active layer;

selectively transferring the vibration through an energy transport layer formed on said active layer to the polishing pad located over said energy transport layer.

25. The method of claim 24 further comprising damping the vibration from all sides of said at least one vibrating module except for a side thereof that contacts said energy transfer layer.

26. The method of claim 24, wherein the selectively vibrating step provides accentuated vibration to a side of said at least one vibrating module that faces said energy transfer layer and attenuated vibration to remaining sides thereof.

27. The method of claim 24, wherein the selectively vibrating step vibrates one of a piezoelectric and a mechanical actuator.

28. The method of claim 24, wherein the selectively vibrating step vibrates one of a megasonic and an ultrasonic transducer.

29. The method of claim 24 further comprising varying an energy transfer characteristic of said energy transport medium over different regions thereof.

30. The method of claim 24 further comprising varying one of a density and a thickness of said energy transport medium over different regions thereof.

31. The method of claim 24 further comprising varying a weave of a mesh embedded in said energy transport medium varies over different regions thereof.

32. A chemical-mechanical polishing apparatus, comprising:

a rotatable platen;

a polishing pad located over said platen for polishing a workpiece; and a device located between said polishing pad and said platen for preventing settlement of particles on the polishing pad, said device including:

a first layer for interfacing with the platen;

a second layer formed on said first layer having at least one vibration module embedded therein; and a third layer formed on said second layer facing the pad and having an energy transport medium.

33. The apparatus of claim 32, wherein said at least one vibration module is surrounded by a damping material on all sides except a side contacting said third layer.

34. The apparatus of claim 32, wherein said at least one vibration module provides accentuated vibration to a side facing said third layer and attenuated vibration to remaining sides thereof.

35. The apparatus of claim 32, wherein said at least one vibration module is one of a piezoelectric and a mechanical actuator.

36. The apparatus of claim 32, wherein said at least one vibration module is one of a megasonic and an ultrasonic transducer.

37. The apparatus of claim 32 further comprising power and signal lines embedded in said first layer and connected to said at least one vibration module.

38. The apparatus of claim 32, wherein said energy transport medium is configured to provide selective energy transfer from said second layer to said polishing pad.

39. The apparatus of claim 32, wherein an energy transfer characteristic of said energy transport medium varies over different regions thereof.

40. The apparatus of claim 32, wherein a density of the energy transport medium varies over different regions thereof.

41. The apparatus of claim 32, wherein a thickness of the energy transport medium varies over different regions thereof.

42. The apparatus of claim 32, wherein the energy transport medium is a mesh embedded in bulk material.

43. The apparatus of claim 42, wherein a weave of the embedded mesh varies over different regions thereof.

44. The apparatus of claim 32, wherein the energy transport medium is a wire mesh.

45. The apparatus of claim 44, wherein the wire is metal.

46. The apparatus of claim 32, wherein said first, second and third layers are formed of a same bulk material.

47. The apparatus of claim 46, wherein said bulk material is a polymer.

48. The apparatus of claim 32, wherein said first, second and third layers are formed from a bulk material of the pad.

49. The apparatus of claim 32, wherein said first, second and third layers are removably formed over each other.

50. The apparatus of claim 32, wherein said first layer is affixed to the platen.

51. The apparatus of claim 32, wherein said first layer is affixed to the platen by an adhesive.

52. The apparatus of claim 32, wherein said second layer has at least one hole for receiving said at least one vibration module.

* * * * *